US008312662B2

(12) United States Patent
Rogers et al.

(10) Patent No.: US 8,312,662 B2
(45) Date of Patent: Nov. 20, 2012

(54) RIFLE END PLATE SLING ADAPTER AND METHOD

(76) Inventors: William H. Rogers, St. Augustine, FL (US); James H. Radney, Jacksonville, FL (US)

( * ) Notice: Subject to any disclaimer, the term of this patent is extended or adjusted under 35 U.S.C. 154(b) by 248 days.

(21) Appl. No.: 12/642,940

(22) Filed: Dec. 21, 2009

(65) Prior Publication Data

US 2010/0162609 A1 Jul. 1, 2010

Related U.S. Application Data

(60) Provisional application No. 61/203,795, filed on Dec. 29, 2008.

(51) Int. Cl.
*F41C 23/02* (2006.01)

(52) U.S. Cl. ..... 42/85

(58) Field of Classification Search ..... 42/85, 74, 42/75.03; 224/150; 24/2.5
See application file for complete search history.

(56) References Cited

U.S. PATENT DOCUMENTS

| | | | | |
|---|---|---|---|---|
| 5,971,239 | A * | 10/1999 | Marable | 224/150 |
| 6,520,390 | B2 * | 2/2003 | Verdugo et al. | 224/150 |
| 6,536,153 | B2 * | 3/2003 | Lindsey | 42/85 |
| 6,598,330 | B2 * | 7/2003 | Garrett et al. | 42/85 |
| 6,775,942 | B2 * | 8/2004 | Compton | 42/85 |
| 7,562,481 | B2 * | 7/2009 | Esch | 42/85 |
| 7,814,697 | B2 * | 10/2010 | Esch | 42/85 |
| 8,171,666 | B2 * | 5/2012 | Karagias | 42/124 |
| 2006/0208016 | A1 * | 9/2006 | Esch | 224/150 |
| 2006/0254113 | A1 * | 11/2006 | Esch | 42/85 |
| 2009/0288325 | A1 * | 11/2009 | Esch | 42/85 |
| 2010/0287808 | A1 * | 11/2010 | King | 42/85 |
| 2011/0138671 | A1 * | 6/2011 | Rogers et al. | 42/85 |

* cited by examiner

*Primary Examiner* — Michael David
(74) *Attorney, Agent, or Firm* — Arthur G. Yeager

(57) ABSTRACT

End plate sling adapter securable to a rifle for a sling, includes a fastener element, sling adapter clamp and locking insert. Sling adapter clamp has a collar defining a central opening extending therethrough, and a pair of fastener housings arranged at respective ends of the collar defining a gap therebetween. Each housing receives a fastener therein such that the fastener extends across the gap and is adjustable to reduce its width. Locking insert has an upper portion with a threaded cradle accommodated within central opening and meshing with a threaded portion of a rifle buttstock receiver extension, and a lower portion extending into the gap.

27 Claims, 9 Drawing Sheets

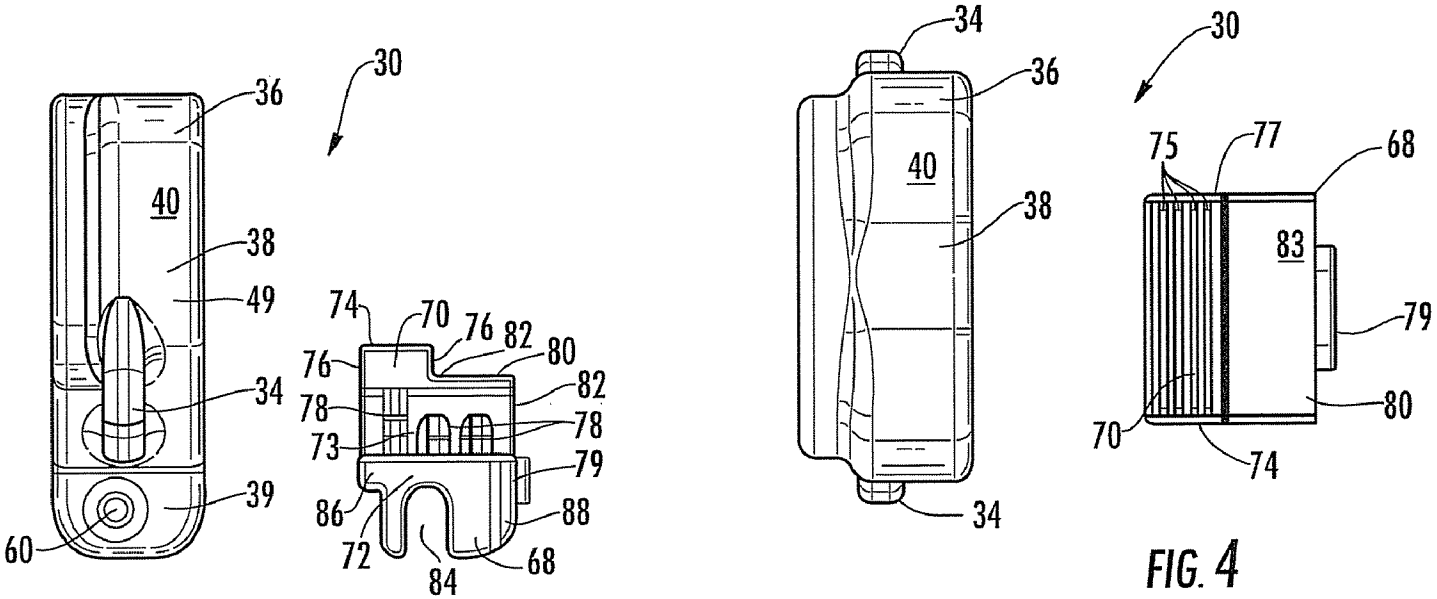
FIG. 4
FIG. 3
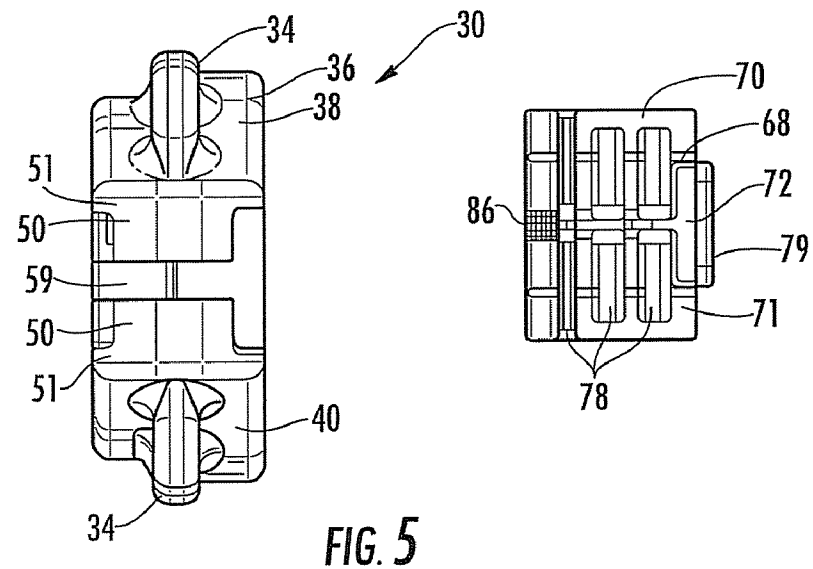
FIG. 5

RIFLE END PLATE SLING ADAPTER AND METHOD

CROSS-REFERENCE TO RELATED APPLICATION

This application claims the benefit of U.S. Provisional Application Ser. No. 61/203,795, filed on Dec. 29, 2008, the contents of which application are hereby incorporated by reference in their entirety.

FIELD OF THE INVENTION

The present invention relates generally to sling adapters to which are attached slings for carrying weapons.

BACKGROUND

A rifle sling is an important accessory that allows the operator of a rifle to keep both hands free while carrying the rifle. A number of sling designs exist. Three common sling designs are the single-point, two-point, and three-point slings. The number of points referenced in each design description refers to the number of points at which the sling is anchored to a weapon. For example, a two-point sling has one end of a sling attached to a forearm of a rifle and the other end attached to a buttstock of the rifle. A single-point rifle sling, on the other hand, attaches at the rear of the rifle's receiver, near the rifle's midpoint. The single-point rifle sling supports the rifle in front of an operator's body, allowing for quick and easy maneuverability of the weapon.

An end plate sling adapter provides an attachment point for the single-mount rifle sling. Generally, the end plate sling adapter is secured to the rifle near the rifle's receiver and has one or two openings to accommodate the attachment of a sling strap or cord. The sling strap or cord is either attached directly to the adapter or is attached via a fastener secured to the strap or cord, such as a spring clip. Some adapters have an opening either on the right-hand or left-hand side of the adapter for use by either right-handed or left-handed operators. Other adapters offer openings on both sides for use by right-handed and left-handed operators.

A number of single-point sling adapter designs attach to the rifle near or adjacent the rifle's end plate, between the buttstock assembly and the receiver. To secure these adapters to the rifle, a telestock (also called the stock body) of the buttstock assembly is removed so that the adapter can be slid over a receiver extension (also called the buffer tube) to a point near or adjacent the rifle's end plate. The adapter is then secured to the receiver extension there, generally by tightening a fastener. One disadvantage of these adapter designs, however, is that over time the adapter can become worn and lose its secure grip on the rifle. This causes the adapter to inadvertently slip down the receiver extension, shifting the anchor point of the single-point rifle sling.

Other adapter designs require removal of the buttstock assembly for proper installation. Such disassembly includes removal of the receiver extension and a receiver extension nut (also called a castle nut). Once removed, an existing end plate is replaced with the end plate sling adapter and the buttstock assembly is reinstalled on the rifle. A disadvantage of these adapter designs is that additional work, and perhaps skill, is required to install the adapter.

Generally, end plate sling adapters are made of metal, such as steel or aluminum. Although such materials provide for sturdy construction, such materials can also add expense to the manufacture of these adapters.

SUMMARY OF THE INVENTION

In view of the foregoing, it is an object of the present invention to provide an improved end plate sling adapter and related methods. According to an embodiment of the present invention, an end plate sling adapter includes a fastener element, a sling adapter clamp and a locking insert. The sling adapter clamp has a collar defining a central opening extending therethrough, and a pair of fastener housings arranged at respective ends of the collar defining a gap therebetween, each fastener housing receiving the fastener element therein such that the fastener element extends across the gap and is adjustable to reduce a width thereof. The locking insert has an upper portion accommodated within the central opening and a lower portion extending into the gap between the pair of fastener housings.

According to a method aspect of the present invention, a method of attaching an end plate sling adapter to a rifle includes arranging a sling adapter clamp around a receiver extension of a buttstock assembly of the rifle, positioning a locking insert into the sling adapter clamp, and tightening a fastener element in the sling adapter clamp to securely engage the receiver extension between the sling adapter clamp and the locking insert.

Advantageously, the end plate sling adapter has attachment openings for use by both right-handed and left-handed operators, does not require extensive disassembly to install, and maintains its grip on a rifle over time. In addition, the end plate sling adapter of the present invention can be constructed from sturdy, relatively inexpensive, plastic materials, and can be used to provide an attachment point for a single-point rifle sling.

These and other objects, aspects and advantages of the present invention will be better understood in view of the drawings and following detailed description of a preferred embodiment.

BRIEF DESCRIPTION OF THE DRAWINGS

FIG. 3 is an exploded right side view of the end plate sling adapter of FIG. 1;

FIG. 4 is an exploded top view of the end plate sling adapter shown of FIG. 1;

FIG. 5 is an exploded bottom view of the end plate sling adapter of FIG. 1;

DETAILED DESCRIPTION OF A PREFERRED EMBODIMENT

Figure 2:
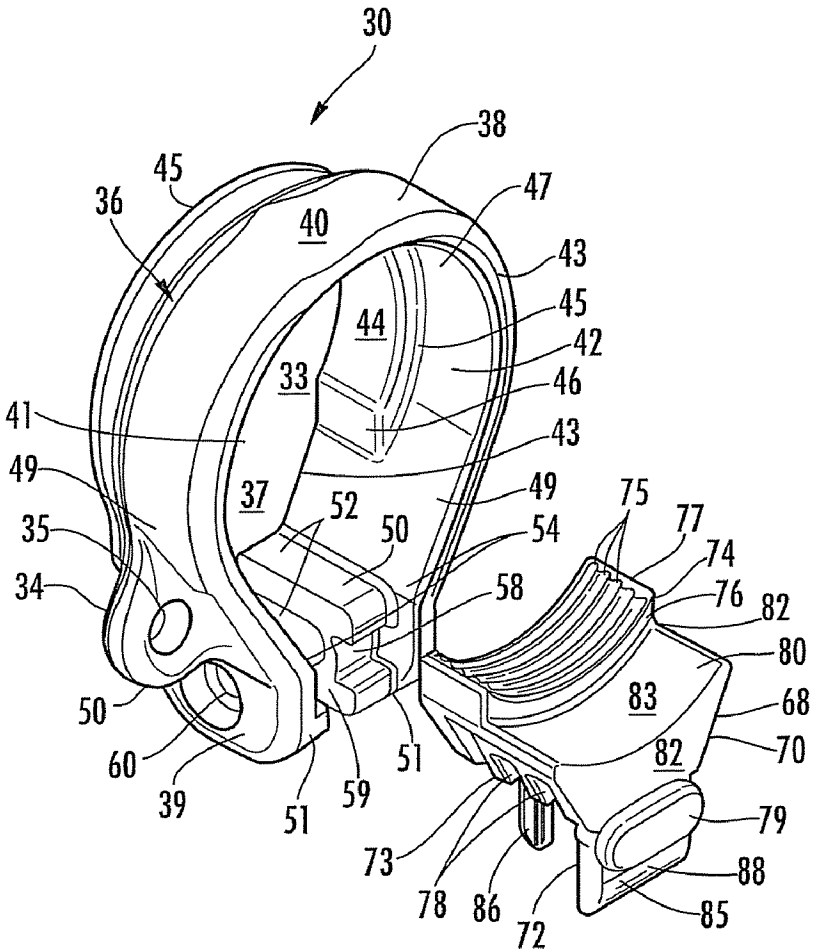
FIG. 2 is an exploded top perspective view of the end plate sling adapter of FIG. 1.

Embodying the principles of the present invention is an end plate sling adapter, a preferred embodiment of which is depicted in FIGS. 1-18 and designated generally by reference numeral 30. The end plate sling adapter 30 is shown in several of the FIGS. together with a rifle, designated generally by reference numeral 90.

The end plate sling adapter 30 is primarily constructed of a sturdy, plastic material, such as nylon. The sling adapter 30 is configured to slide over a receiver extension 93 of a buttstock assembly 91 of the rifle 90 and to be firmly secured to the receiver extension 93, as will be explained more fully herebelow. Attachment ears 34 provide attachment points for securing a harness to the sling adapter 30, as also explained more fully herebelow.

Referring now to FIGS. 1-5, the end plate sling adapter 30 includes a sling adapter clamp 36. The sling adapter clamp 36 comprises a collar 38 and a spaced pair of opposing fastener housings 50 (see FIGS. 1, 2, and 5). The collar 38 is principally a band formed in a generally elliptical shape so as to define a central opening 41 (see FIGS. 1 and 2). A generally cylindrical upper portion 33 (see FIGS. 1 and 2) of the central opening 41 is sized to receive the receiver extension 93 (see FIGS. 10-18) of the buttstock assembly 91 (see FIGS. 12 and 15) of the rifle 90 (see FIGS. 10-18). Opposing ends 39 (see FIGS. 1-3) of the collar 38 are spaced apart and bracket the pair of fastener housings 50. Each end 39 of the collar 38 is adjacent to an end 51 (see FIGS. 1, 2, and 5) of a respective fastener housing 50. At generally the locations where each end 39 of the collar 38 meets an end 51 of the respective fastener housing 50, the collar 38 abruptly changes shape from gradually curved to substantially vertical. The substantially vertical ends 39 of the collar 38 are aligned adjacent to, and formed integrally with, the substantially vertical ends 51 of the fastener housings 50.

Figure 1:
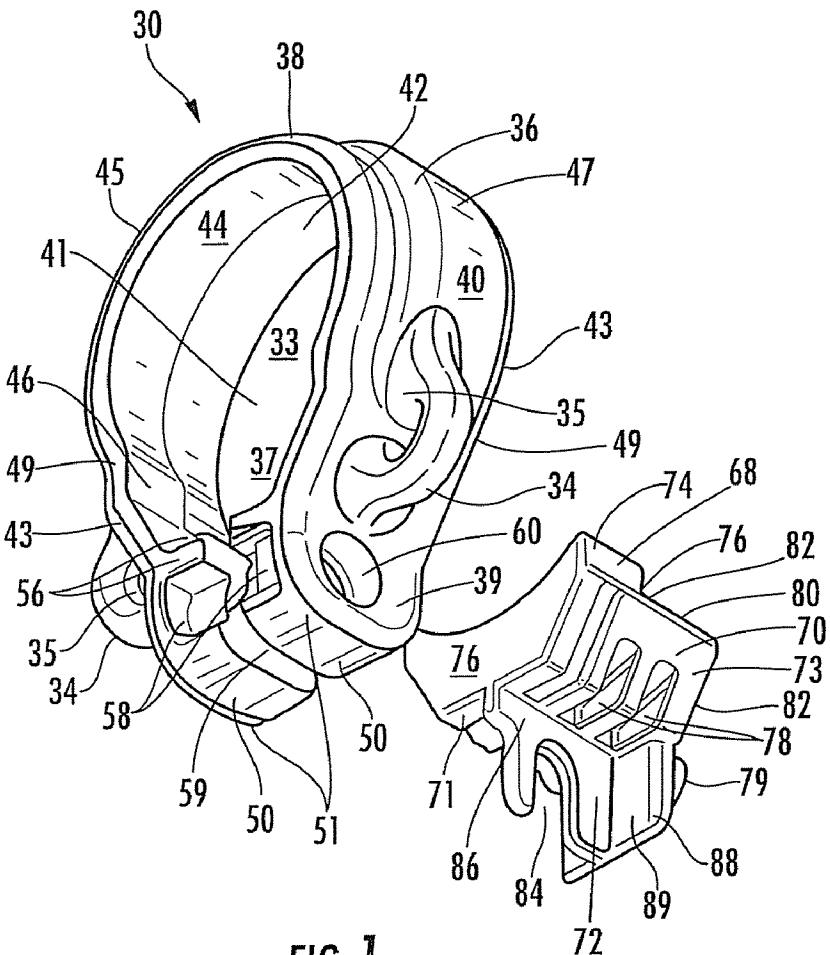
FIG. 1 is an exploded bottom perspective view of an end plate sling adapter having a sling adapter clamp and a locking insert, according to an embodiment of the present invention.
Figure 7:
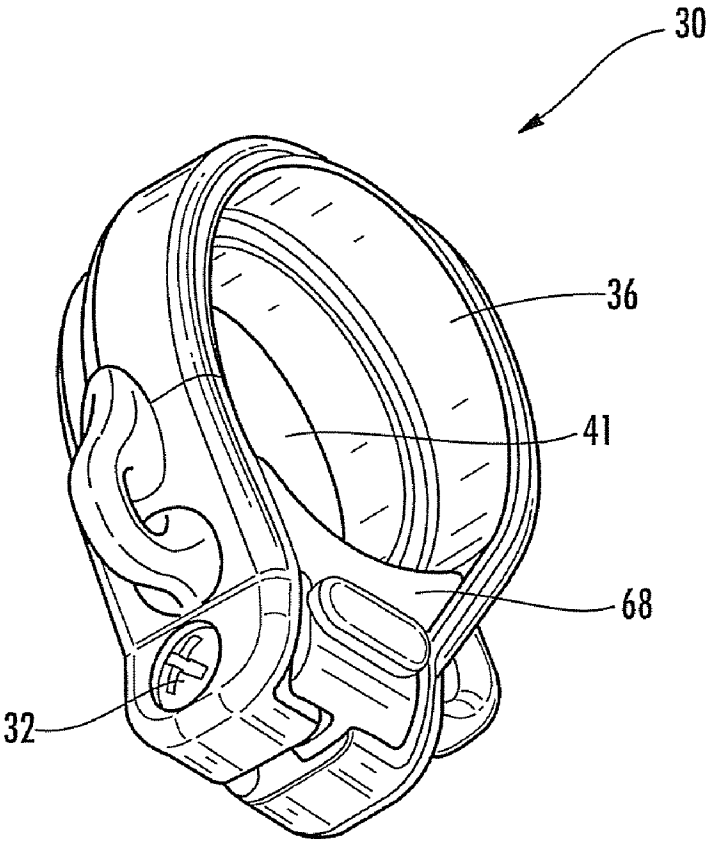
FIG. 7 is a bottom perspective view of the end plate sling adapter of FIG. 6.
Figure 6:
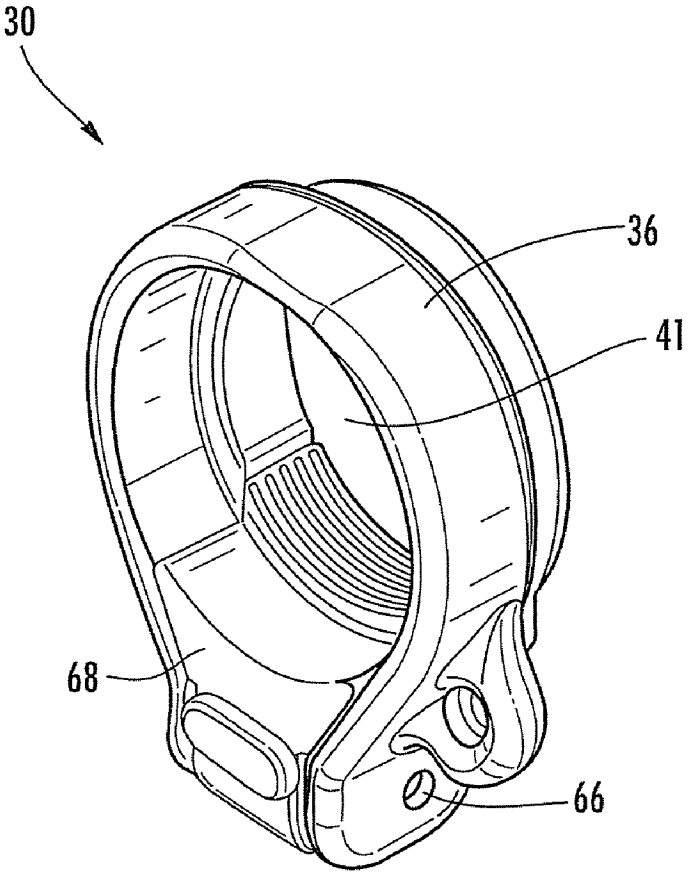
FIG. 6 is a non-exploded top perspective view of the end plate sling adapter of FIG. 1, also including a fastener element.
Figure 9:
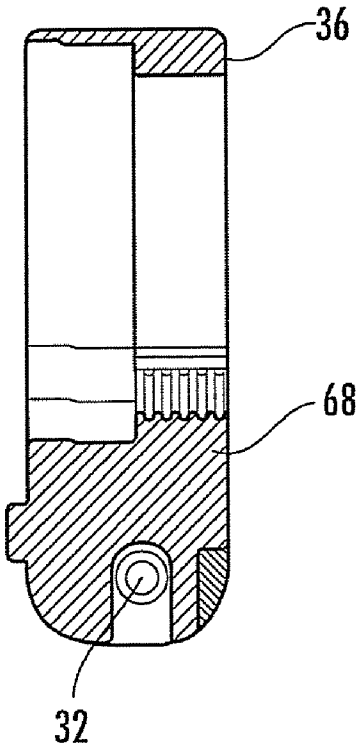
FIG. 9 is a sectional view taken along line 9-9 of FIG. 8.
Figure 8:
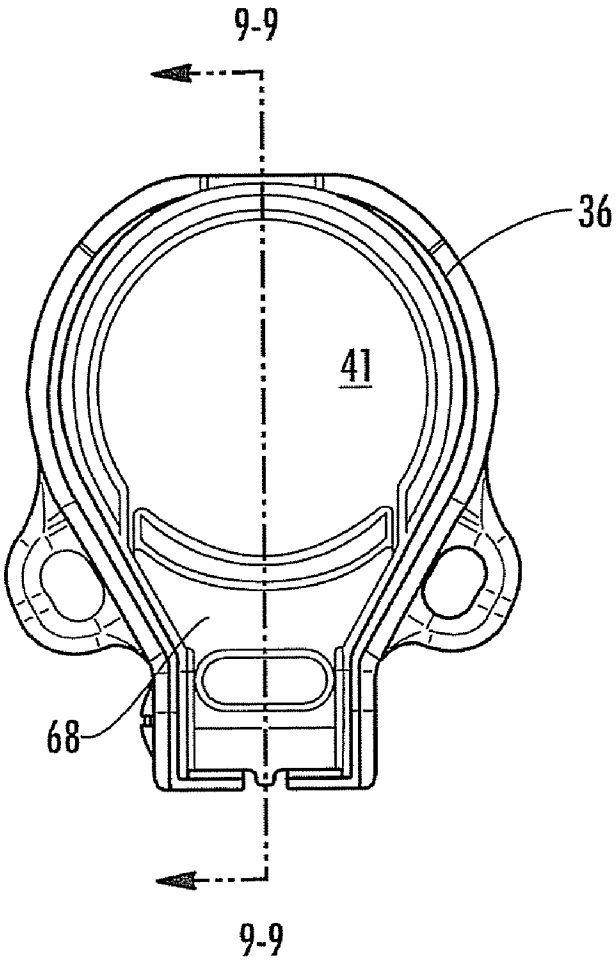
FIG. 8 is a front view of the end plate sling adapter of FIG. 6.

Referring now to FIGS. 1 and 2, a ridge 44 is formed integrally with an interior surface 42 of the collar 38. The width of the ridge 44 is about half the width of the collar 38. The ridge 44 extends around the interior surface 42 of the collar 38, beginning from generally a middle portion 49 of the collar 38 proximate one end 39 of the collar 38, through an upper portion 47 of the collar 38, and to generally the middle portion 49 of the collar 38 proximate another end 39 of the collar 38. The thickness of the ridge 44 is tapered at each end 46 of the ridge 44. The ridge 44 is configured such that an edge 45 of the ridge 44 defines an edge 43 of the collar 38 for the length of the ridge 44, whereupon the edge 45 of the ridge 44 adjacent each end 46 of the ridge 44 is formed integrally with the remaining edge 43 of the collar 38. The ridge 44 is positioned within the collar 38 so as to ensure a close fit between the ridge 44 and the receiver extension 93 (see FIGS. 10-18) while not interfering with the fit between the interior surface 42 of the collar 38 absent the ridge 44 and a receiver extension nut 94 (see FIGS. 11 and 16-18) of the buttstock assembly 91 (see FIGS. 12 and 15) of the rifle 90 (see FIGS. 10-18). The ridge 44 extends for about two-hundred-seventy degrees around the interior surface 42 of the collar 38.

Continuing with FIGS. 1 and 2, an unthreaded opening 60 of the sling adapter clamp 36 passes through an end 39 of the collar 38 and on through a first fastener housing 50. A threaded opening 66 (see FIG. 6) of the sling adapter clamp 36 passes through another end 39 of the collar 38 and on through a second fastener housing 50. The openings 60, 66 are aligned so that a fastener element 32 (see FIGS. 11, 13, 14, and 16-18), such as a number six screw, can be passed through the unthreaded opening 60 and into the threaded opening 66, thereby spanning a gap 59 between the fastener housings 50. In this way, the screw 32 is used to draw together the two ends 39 of the collar 38 to assist in firmly securing the sling adapter 30 to the receiver extension 93, as described below with reference to FIGS. 12-18.

Still referring to FIGS. 1 and 2, each fastener housing 50 includes a spaced pair of opposing faces 54, 56 in which a recessed face 54 opposes a flush face 56. The recessed faces 54 of the fastener housings 50 are located proximate each other, with each recessed face 54 recessed from an edge 43 of the collar 38. The flush faces 56 of the fastener housings 50 are located proximate each other, with each flush face 56 aligned generally flush with the same edge 43 of the collar 38 that is generally flush with the edge 45 of the ridge 44 of the collar 38. Depressions 58 are located in each face 54, 56 of each fastener housing 50 for reducing the amount of material used in the sling adapter clamp 36, as is common in the art of molding plastic material.

Referring now to FIGS. 1-5, the sling adapter 30 further includes a spaced pair of attachment ears 34. Each ear 34 is formed integrally with an exterior surface 40 of the collar 38 in a middle portion 49 of the collar 38. Each ear 34 contains an opening 35 (see FIGS. 1 and 2) through which a cord, strap, or connector of a harness (not shown) is attached in order to secure the harness to the sling adapter 30, as described below with reference to FIGS. 12-18.

Referring now to FIGS. 6-9, the sling adapter 30 also includes a locking insert 68. During assembly of the sling adapter 30, as described below with reference to FIGS. 12-18, the locking insert 68 is placed within a generally wedge-shaped lower portion 37 (see FIGS. 1 and 2) of the central opening 41 (see FIGS. 6-8) of the sling adapter clamp 36 that is shaped and sized to receive the locking insert 68. The locking insert 68 is used to ensure that the sling adapter 30 is secured firmly to the receiver extension 93 (see FIGS. 10-18) of the buttstock assembly 91 (see FIGS. 12 and 15) of the rifle 90 (see FIGS. 10-18) in a manner that prevents the sling adapter 30 from slipping down the receiver extension 93 over time.

Referring now to FIGS. 1-5, the locking insert 68 comprises a threaded cradle 74 (see FIGS. 1-4), an extension nut cradle 80 that is threadless (see FIGS. 1-4), depressions 78 (see FIGS. 1, 2, 3, and 5), a tab 86 (see FIGS. 1, 2, 3, and 5), and a flange 88 (see FIGS. 1-3). A substantial portion of a first end 76 (see FIGS. 1-3) of the threaded cradle 74 is formed integrally with an adjacent first end 82 (see FIGS. 1-3) of the extension nut cradle 80, such that together the cradles 74, 80 form an upper portion 70 of the locking insert 68. The threaded cradle 74 is concave and formed to fit over a portion of exposed threads 99 (see FIGS. 11, 13, and 16-18) of the receiver extension 93 (see FIGS. 10-18). The threads 75 (see FIGS. 2 and 4) of the threaded cradle 74 fit within the threads 99 of the receiver extension 93 so that when the sling adapter 30 is tightened, the intermeshing threads 75, 99 prevent the locking insert 68, and thereby the adapter 30, from moving longitudinally along the receiver extension 93.

Continuing with FIGS. 1-5, the extension nut cradle 80 is also concave and formed to fit over a part of the receiver extension nut 94 (see FIGS. 11 and 16-18) of the buttstock assembly 91 (see FIGS. 12 and 15) of the rifle 90 (see FIGS. 10-18). (Note that in assembling the rifle 90, the receiver extension nut 94 is threaded onto a portion of the threads 99 of the receiver extension 93.) A top surface 83 (see FIGS. 2 and 4) of the extension nut cradle 80 is situated below a top surface 77 (see FIGS. 2 and 4) of the threaded cradle 74. This structure is necessary to ensure a close fit between the extension nut cradle 80 and the receiver extension nut 94 and between the threaded cradle 74 and the threads 99 of the receiver extension 93. The depressions 78 located in a bottom surface 71 (see FIGS. 1 and 5) and sides 73 (see FIGS. 1-3) of the upper portion 70 of the locking insert 68 are included for reducing the amount of material used in the locking insert 68, as is common in the art of molding plastic material.

Still referring to FIGS. 1-5, the flange 88 of the locking insert 68 extends laterally from a second end 82 of the extension nut cradle 80 opposite the first end 82 and is formed integrally with the second end 82. A front face 85 (see FIG. 2) of the flange 88 is aligned generally coplanar with the second end 82. A locking stop 79 protrudes approximately one-sixteenth of an inch from the front face 85 of the flange 88 and is formed integrally with the front face 85. The tab 86 of the locking insert 68 is aligned substantially along the center of the bottom surface 71 of the upper portion 70 of the locking insert 68. The tab 86 extends along the bottom surface 71 from a second end 76 of the threaded cradle 74 opposite the first end 76 of the threaded cradle 74 to a rear face 89 (see FIG. 1) of the flange 88. The tab 86 is formed integrally with both the rear face 89 and with the bottom surface 71. In addition, the tab 86 contains an elongated notch 84 (see FIGS. 1-3) approximately midway along its length. Together, the tab 86 and the flange 88 form a lower portion 72 (see FIGS. 1, 2, 3, and 5) of the locking insert 68.

Figures 10, 11:
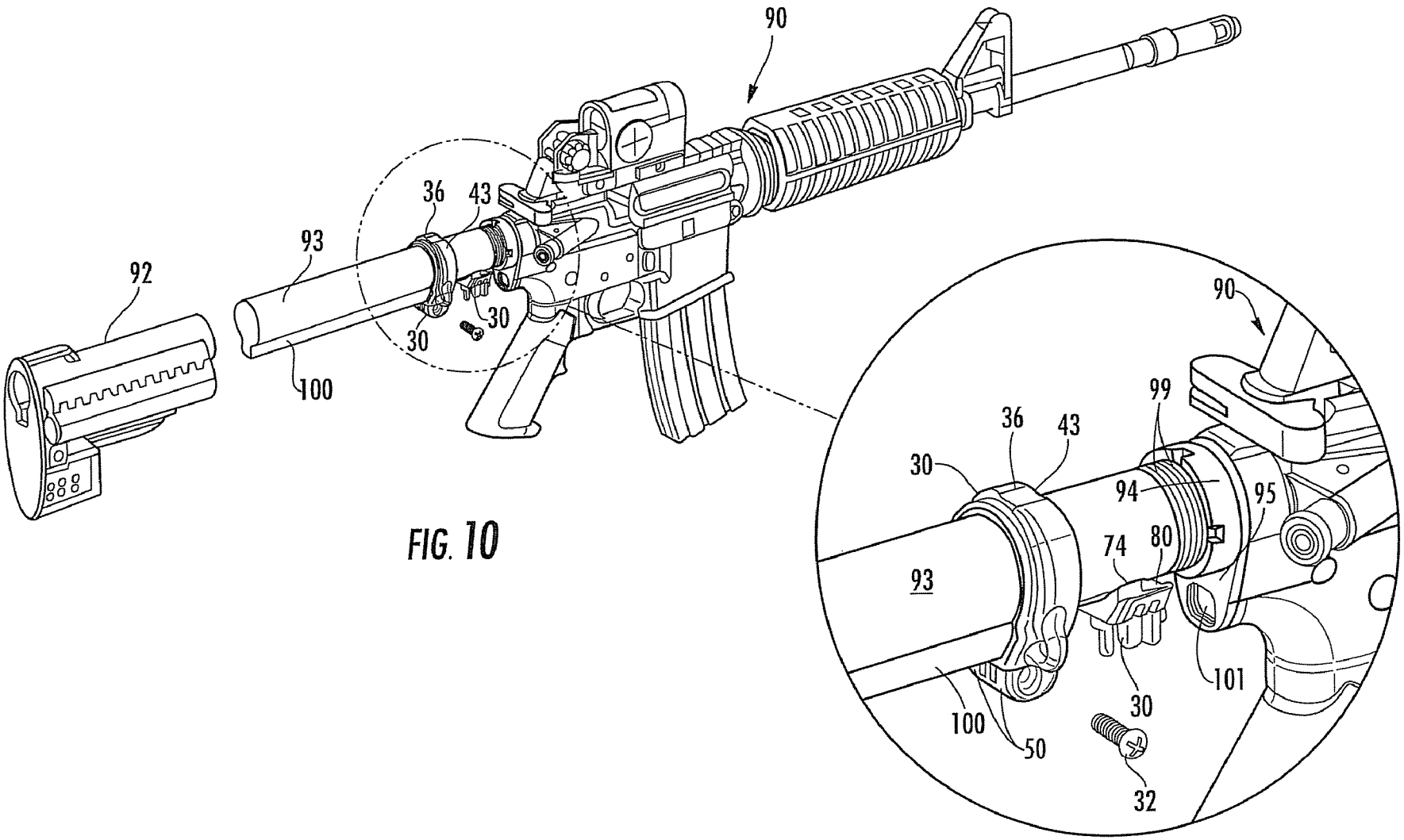
FIG. 10 is a top perspective view of the end plate sling adapter of FIG. 6, during installation on a rifle.
FIG. 11 is a detail view of the indicated portion of FIG. 10.
Figure 12:
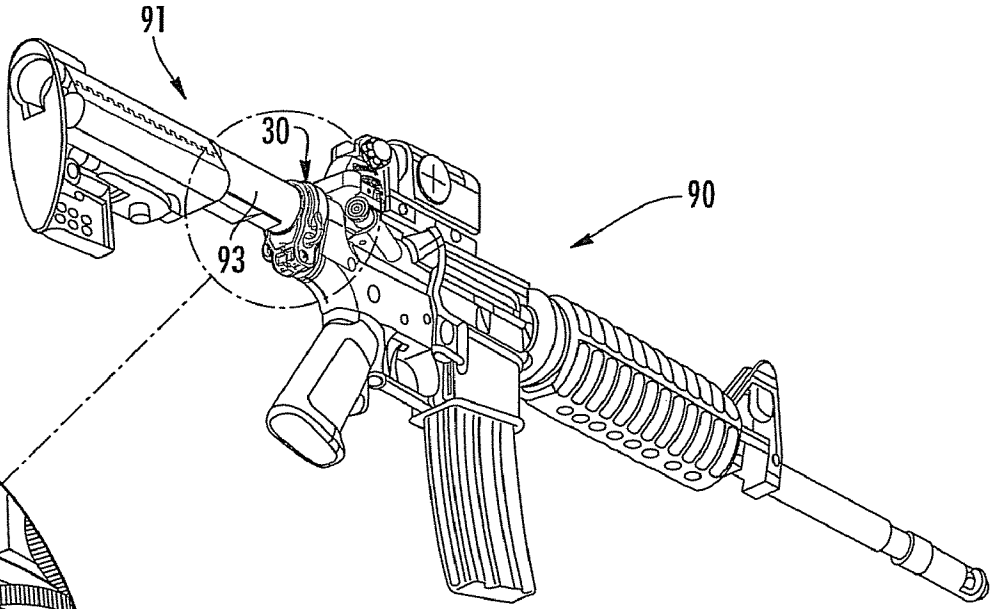
FIG. 12 is a bottom perspective view of the end plate sling adapter of FIG. 6, installed on a rifle.
Figure 13:
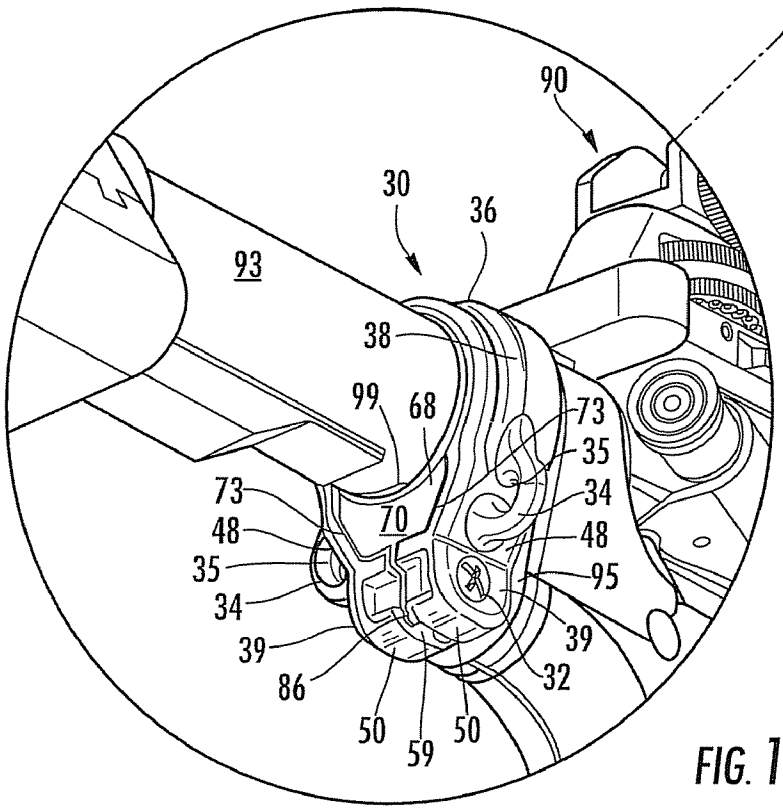
FIG. 13 is a detail view of the indicated portion of FIG. 12.
Figure 14:
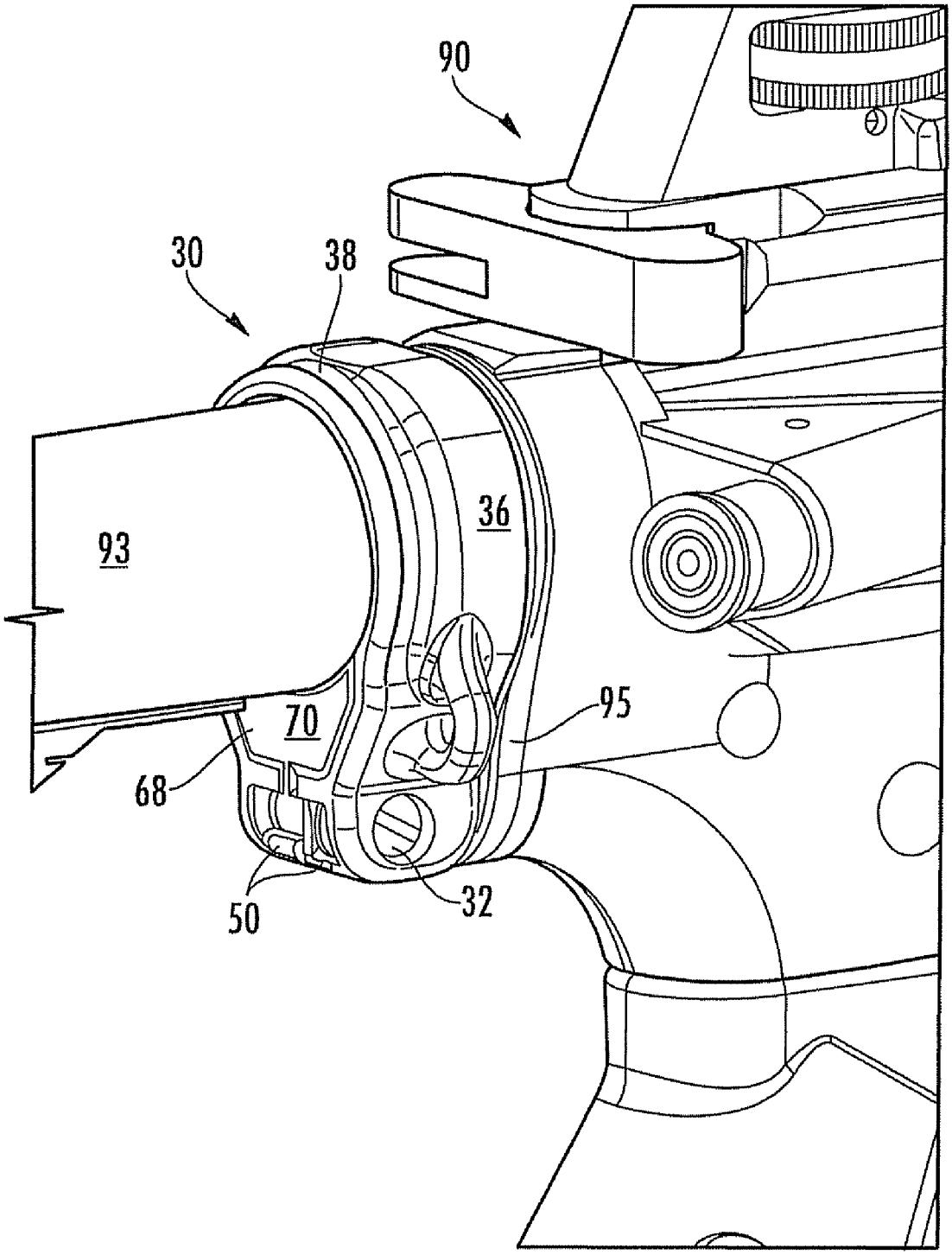
FIG. 14 is a partial rear perspective view of the end plate sling adapter and rifle of FIG. 12.
Figures 15, 16:
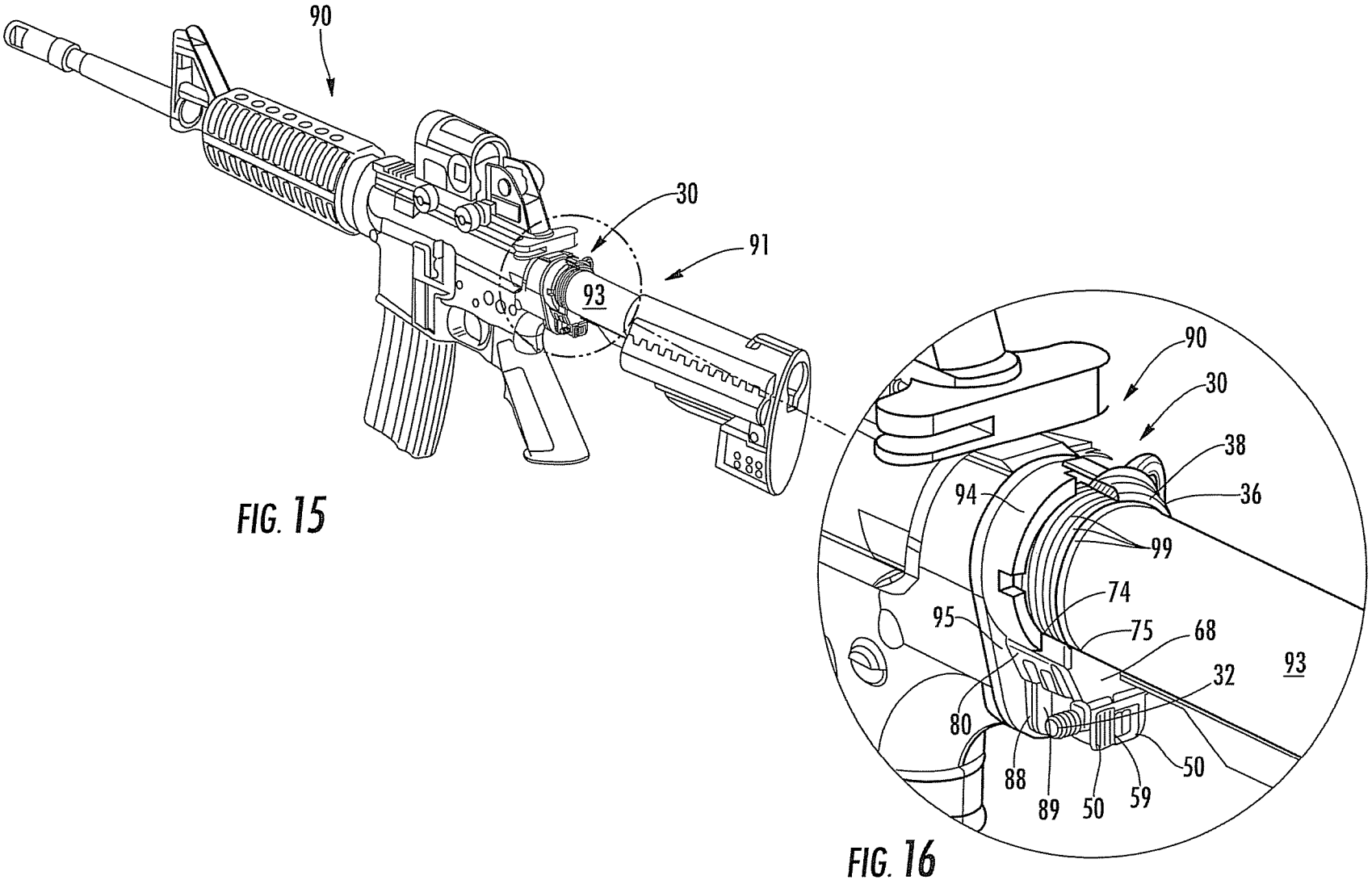
FIG. 15 is a rear perspective view of the end plate sling adapter and rifle of FIG. 12, with components partially cutaway to show details.
FIG. 16 is a detail view of the indicated portion of FIG. 15.
Figure 18:
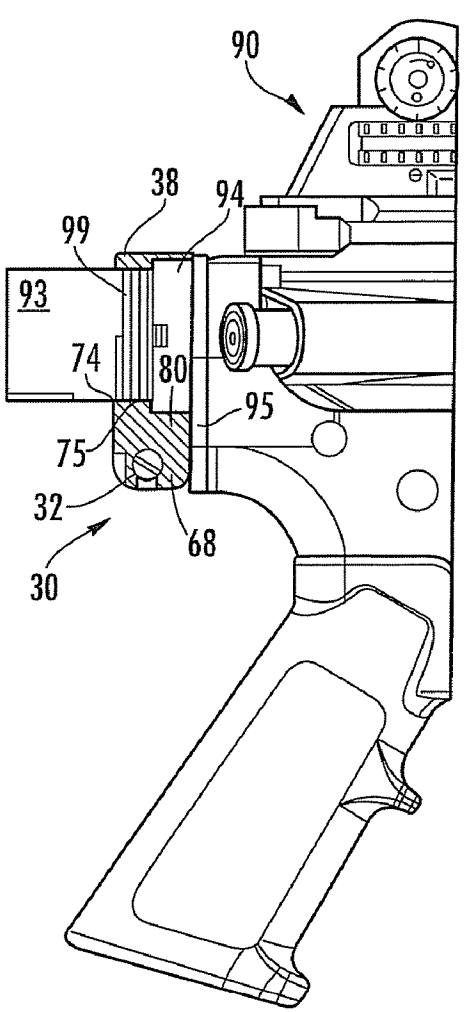
FIG. 18 is a partial right side view of the end plate sling adapter and rifle of FIG. 12, with components partially cutaway to show details.
Figure 17:
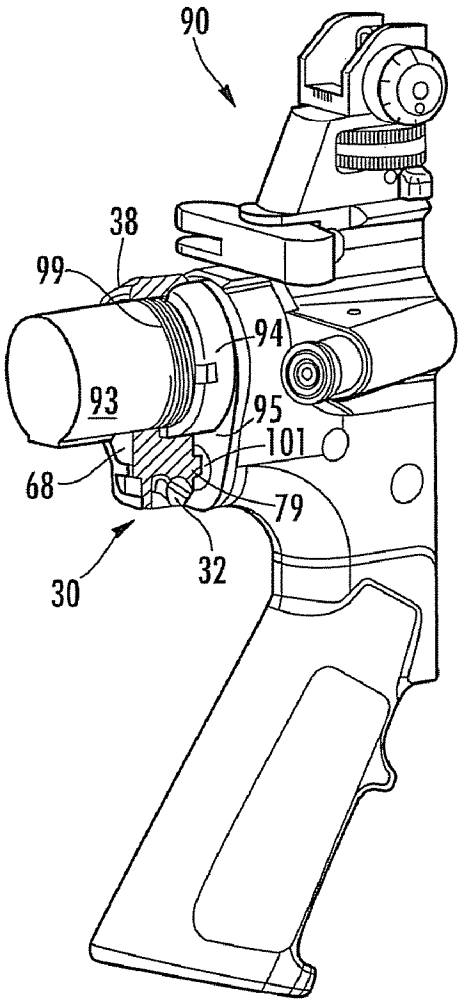
FIG. 17 is a partial rear perspective view of the end plate sling adapter and rifle of FIG. 12, with components partially cutaway to show details.

Referring now to FIGS. 10 and 11, to install the end plate sling adapter 30 onto the rifle 90, a telestock 92 (see FIG. 10) of the buttstock assembly 91 (see FIGS. 12 and 15) of the rifle 90 is first removed from the receiver extension 93 of the buttstock assembly 91. The central opening 41 (see FIGS. 1 and 2) of the sling adapter clamp 36 of the sling adapter 30 is then positioned over an end of the receiver extension 93, with the edge 43 of the collar 38 of the sling adapter clamp 36 proximate the recessed faces 54 (see FIGS. 1 and 2) of the fastener housings 50 (see FIG. 11) of the sling adapter clamp 36 placed over the receiver extension 93 first. The sling adapter clamp 36 is now slid onto the receiver extension 93. As the upper portion 33 (see FIGS. 1 and 2) of the central opening 41 receives the receiver extension 93, the lower portion 37 (see FIGS. 1 and 2) of the central opening 41 is aligned such that it passes over a rib 100 that extends along a bottom portion of the receiver extension 93. The sling adapter clamp 36 is slid along the receiver extension 93 until the sling adapter clamp 36 reaches a point between the rib 100 and the threads 99 (see FIG. 11) of the receiver extension 93.

Referring now to FIGS. 12-18, the locking insert 68 (see FIGS. 13 and 16-18) is placed with locking stop 79 of flange 88 into a cooperative recess 101 and the threaded cradle 74 loosely meshed with threads 99 as more fully described hereinafter. Thereafter the wedge-shaped lower portion 37 (see FIGS. 1 and 2) of the central opening 41 (see FIGS. 1 and 2) of the sling adapter clamp 36 (see FIGS. 13, 14, and 16) is moved so that the free end of the tab 86 (see FIG. 13) of the locking insert 68 is located in the gap 59 (see FIGS. 13 and 16) between the opposing fastener housings 50 (see FIGS. 13, 14, and 16) of the sling adapter clamp 36 at a point proximate the recessed faces 54 (see FIGS. 1 and 2) of the fastener housings 50. (Note that attempting to insert the tab 86 beginning at a point proximate the flush faces 56 (see FIGS. 1 and 2) of the fastener housings 50 will result in misalignment of the locking insert 68 within the sling adapter clamp 36.) The tab 86 is slid through the gap 59 until the rear face 89 (see FIG. 16) of the flange 88 (see FIG. 16) of the locking insert 68 contacts the recessed faces 54. This results in the threaded cradle 74 (see FIGS. 16 and 18) of the locking insert 68 being positioned between the ends 46 (see FIGS. 1 and 2) of the ridge 44 (see FIGS. 1 and 2) of the collar 38 (see FIGS. 13, 14, and 16-18) of the sling adapter clamp 36, and the bottom surface 71 (see FIGS. 1 and 5) of the upper portion 70 (see FIGS. 13 and 14) of the locking insert 68 being positioned adjacent top surfaces 52 (see FIG. 2) of the fastener housings 50.

Continuing with FIGS. 12-18, the sling adapter 30 is moved adjacent the receiver extension nut 94 (see FIGS. 16-18) of the buttstock assembly 91 (see FIGS. 12 and 15) and pushed onto the receiver extension nut 94 until tab 86 is seated with the locking stop 79 (see FIG. 17) of the flange 88 having been located in a cooperative recess 101 (see FIG. 17) of an end plate 95 (see FIGS. 13, 14, and 16-18) of the buttstock assembly 91. When sling adapter 30 is fully assembled and attached to the rifle 90, the locking stop 79 and recess 101 of end plate 95 prevents relative rotative movement of the adapter 30 on the rifle 90. This positioning results in the extension nut cradle 80 (see FIGS. 16 and 18) being located beneath the receiver extension nut 94, and the threaded cradle 74 being located beneath the threads 99 (see FIGS. 13 and 16-18) of the receiver extension 93 with the threads 75 (see FIGS. 16 and 18) of the threaded cradle 74 intermeshed with, or in an intermeshing position relative with, the threads 99 of the receiver extension 93. At this point, the locking insert 68 sits loosely within the lower portion 37 of the central opening 41 of the sling adapter clamp 36. Tightening the sling adapter 30 using screw 32 results in a tight fit between the extension nut cradle 80 and the receiver extension nut 94 and between the threaded cradle 74 and the threads 99 of the receiver extension 93, as hereinafter more full described (see FIGS. 13, 14, and 16-18).

Still referring to FIGS. 12-18, the screw 32 is passed through the unthreaded opening 60 (see FIGS. 1 and 2) of the sling adapter clamp 36, through the notch 84 (see FIGS. 1-3) in the tab 86, and into the threaded opening 66 (see FIG. 6) of the sling adapter clamp 36 and tightened. Tightening the screw 32 draws together the two ends 39 (see FIG. 13) of the collar 38 of the sling adapter clamp 36. As the two ends 39 are drawn together, the angled lower portions 48 (see FIG. 13) of the collar 38 engage against angled sides 73 (see FIG. 13) of the upper portion 70 of the locking insert 68 and force the locking insert 68 upwardly toward the receiver extension nut 94 and the threads 99 of the receiver extension 93. This movement causes the extension nut cradle 80 to tighten around the receiver extension nut 94 and also causes the threaded cradle 74 to tighten around the receiver extension 93, thereby securing the sling adapter 30 firmly in place. In addition, with the threads 75 of the threaded cradle 74 tightly intermeshed with the threads 99 of the receiver extension 93, the sling adapter 30 is prevented from moving longitudinally along the receiver extension 93 until, or unless, the screw 32 is loosened, for example.

Continuing with FIGS. 12-18, to secure the harness or sling (not shown) to the sling adapter 30, a cord, strap, or connector of the harness is attached to one of the ears 34 (see FIG. 13) of the sling adapter 30 using the opening 35 (see FIG. 13) in the selected ear 34, as well known in the art.

The present invention is not necessarily limited to the embodiment herein shown and described. Rather, those skilled in the art will appreciate that numerous modifications, as well as adaptations to particular circumstances, will fall within the scope of the present invention as shown and described and of the appended claims.

What is claimed is:

1. An end plate sling adapter comprising:

a fastener element;

a sling adapter clamp for a receiver extension of a buttstock assembly of a rifle, having a collar defining a central opening extending therethrough, and a pair of fastener housings arranged at respective ends of the collar defining a gap therebetween, each fastener housing receiving the fastener element therein such that the fastener element extends across the gap and is adjustable to reduce a width thereof; and a locking insert having an upper portion accommodated within the central opening and a lower portion extending into the gap between the pair of fastener housings.

2. The adapter of claim 1, wherein the fastener element is a screw.

3. The adapter of claim 1, wherein the central opening includes a generally cylindrical portion dimensioned to closely accommodate a portion of a rifle buttstock assembly therein.

4. The adapter of claim 3, wherein the central opening further includes a generally wedge-shaped portion accommodating the upper portion of the locking insert.

5. The adapter of claim 4, wherein the upper portion of the locking insert includes a cradle further defining the cylindrical portion of the central opening.

6. The adapter of claim 1, wherein the sling adapter clamp further includes a ridge on an inner surface of the collar partially surrounding the central opening.

7. The adapter of claim 6, wherein the ridge forms a reduced diameter portion of the central opening, the reduced diameter portion dimensioned to closely accommodate a receiver extension of a rifle buttstock assembly.

8. The adapter of claim 7, wherein the upper portion of the locking insert includes a cradle effectively continuing the ridge and further forming the reduced diameter portion of the central opening.

9. The adapter of claim 8, wherein the cradle is threaded.

10. The adapter of claim 1, wherein the upper portion of the locking insert includes a threaded cradle.

11. The adapter of claim 10, wherein the upper portion of the locking insert further includes a threadless cradle adjacent to the threaded cradle.

12. The adapter of claim 1, wherein the lower portion of the locking insert includes a tab inserted into the gap between the fastener housings.

13. The adapter of claim 12, wherein a notch is defined in the tab and the fastener element extends through the notch.

14. The adapter of claim 12, wherein the lower portion of the locking insert further includes a flange approximately perpendicular to the tab and overlying respective faces of the fastener housing.

15. The adapter of claim 14, wherein the respective faces of the fastener housing are recessed faces.

16. The adapter of claim 14, wherein the flange includes a locking stop protruding from a front face thereof.

17. The adapter of claim 1, wherein the sling adapter clamp and the locking insert are molded from rigid plastic material.

18. A method of attaching an end plate sling adapter in accord with claim 1 to a rifle, the method comprising:

arranging the sling adapter clamp around a receiver extension of a buttstock assembly of the rifle;

positioning the locking insert into the sling adapter clamp; and tightening the fastener element in the sling adapter clamp to securely engage the receiver extension between the sling adapter clamp and the locking insert.

19. The method of claim 18, wherein positioning the locking insert into the sling adapter clamp is performed after arranging the sling adapter clamp around the receiver extension.

20. The method of claim 18, wherein the sling adapter clamp is configured such that tightening the fastener element urges the locking insert into engagement with the receiver extension.

21. The method of claim 18, wherein the locking insert includes a threaded cradle, the sling adapter clamp and locking insert are positioned to align the threaded cradle with a threaded portion of the receiver extension.

22. The method of claim 21, wherein the locking insert includes a threadless cradle, and the sling adapter clamp and locking insert are positioned to align the threadless cradle with a receiver extension nut.

23. The method of claim 18, wherein the locking insert includes a flange with a locking stop protruding therefrom, and the sling adapter clamp and locking insert are positioned such that the locking stop engages an end plate of the buttstock assembly.

24. The method of claim 18, wherein the sling adapter clamp includes a collar defining a central opening extending therethrough and having a ridged portion on an inner surface thereof partially surrounding the central opening; and the sling adapter damp and locking insert are positioned such that a non-ridged portion of the collar is aligned with a receiver extension nut.

25. An end plate sling adapter comprising:

a fastener element;

a sling adapter clamp having a collar defining a central opening extending therethrough, and a pair of fastener housings arranged at respective ends of the collar defining a gap therebetween, each fastener housing receiving the fastener element therein such that the fastener element extends across the gap and is adjustable to reduce a width thereof;

a locking insert having an upper portion accommodated within the central opening and a lower portion extending into the gap between the pair of fastener housings, the upper portion of the locking insert includes threads for meshing with a threaded portion of a receiver extension of a buttstock assembly of a rifle;

the central opening includes a generally cylindrical portion dimensioned to closely accommodate a portion of a rifle buttstock assembly therein and a generally wedge-shaped portion accommodating the upper portion of the locking insert;

the upper portion of the locking insert includes a cradle further defining the cylindrical portion of the central opening; and the sling adapter clamp and locking insert are molded from rigid plastic material.

26. The adapter of claim 25, wherein the sling adapter clamp further includes a ridge on an inner surface of the collar partially surrounding the central opening, the ridge forming a reduced diameter portion of the central opening, the reduced diameter portion dimensioned to closely accommodate a receiver extension of a rifle buttstock assembly; and the locking insert including a threaded cradle effectively continuing the ridge and further forming the reduced diameter portion of the central opening.

27. The adapter of claim 25, wherein the lower portion of the locking insert includes a tab inserted into the gap between the fastener housings, a notch is defined in the tab and the fastener element extends through the notch.

* * * * *